US009327872B2

(12) United States Patent
Glaser et al.

(10) Patent No.: US 9,327,872 B2
(45) Date of Patent: May 3, 2016

(54) PRODUCT CONTAINER HAVING NARROWED WAIST PORTION

(71) Applicant: Fisher Scientific Company L.L.C., Fair Lawn, NJ (US)

(72) Inventors: John T. Glaser, Clifton Park, NY (US); Jack A. Rodriguez, Bernardsville, NJ (US)

(73) Assignee: Fisher Scientific Company, L.L.C., Fair Lawn, NJ (US)

( * ) Notice: Subject to any disclaimer, the term of this patent is extended or adjusted under 35 U.S.C. 154(b) by 62 days.

(21) Appl. No.: 14/199,649

(22) Filed: Mar. 6, 2014

(65) Prior Publication Data

US 2015/0251810 A1 Sep. 10, 2015

(51) Int. Cl.

| | |
|---|---|
| ***B65D 90/02*** | (2006.01) |
| ***B65D 23/10*** | (2006.01) |
| ***B65D 1/02*** | (2006.01) |

(52) U.S. Cl.

CPC ..... *B65D 23/102* (2013.01); *B65D 1/0223* (2013.01); *B65D 2501/0081* (2013.01)

(58) Field of Classification Search

CPC ..... B65D 1/0223; B65D 2501/0081; B65D 23/102; B29L 2031/463

See application file for complete search history.

(56) References Cited

U.S. PATENT DOCUMENTS

| | | | | |
|---|---|---|---|---|
| 1,602,391 | A | 10/1926 | Creaver | |
| 4,113,129 | A | 9/1978 | Cambio, Jr. | |
| D262,267 | S | 12/1981 | Cox | |
| 5,199,587 | A * | 4/1993 | Ota et al. | 215/381 |
| 5,472,105 | A * | 12/1995 | Krishnakumar et al. | 215/384 |
| D379,763 | S * | 6/1997 | Ewing, Jr. | D9/520 |
| D393,210 | S | 4/1998 | Ewing, Jr. | |
| D454,501 | S | 3/2002 | Tornaletti et al. | |
| 7,118,002 | B2 * | 10/2006 | Saito et al. | 215/384 |
| 7,980,404 | B2 | 7/2011 | Trude et al. | |
| D703,541 | S * | 4/2014 | Yourist et al. | D9/541 |
| 2007/0267378 | A1 * | 11/2007 | Piccinino et al. | 215/6 |

FOREIGN PATENT DOCUMENTS

| | | | |
|---|---|---|---|
| EP | 2322436 | A1 | 5/2011 |
| FR | 1532002 | A | 7/1968 |
| WO | 2013164170 | A1 | 11/2013 |

OTHER PUBLICATIONS

U.S. Patent and Trademark Office, Notification of Transmittal of the International Search Report and the Written Opinion of the International Searching Authority in Application No. PCT/US2015/013767, Mar. 31, 2015 (10 pages).

* cited by examiner

*Primary Examiner* — Shawn M Braden

(74) *Attorney, Agent, or Firm* — Wood, Herron & Evans, LLP

(57) ABSTRACT

A product container includes a top portion defining an opening, a bottom portion defining a base, and a central portion including a plurality of sidewalls extending between the top and bottom portions. Three of the sidewalls include discrete planar facets that collectively define a narrowed waist portion, at which the product container has smaller dimensions or a smaller cross sectional area compared to the top portion and the bottom portion. The narrowed waist portion is configured to be gripped by a user for lifting the product container (even when wearing gloves), and a flat product label may also be placed on the product container at the narrowed waist portion. The narrowed waist portion provides a natural gripping location as well as clearance between abutting product containers when multiple abutting product containers are located on a shelf.

19 Claims, 5 Drawing Sheets

PRODUCT CONTAINER HAVING NARROWED WAIST PORTION

TECHNICAL FIELD

The present invention generally relates to containers and, more particularly, to a product container having contours to enhance gripping and product labeling of the container.

BACKGROUND

Many container designs are known for holding various items, such as liquid and solid particulate consumer or commercial goods. For example, a typical round jug-like container for holding bleach is clearly distinct from a generally rectilinear box for containing apple juice. Depending on the size and shape of the container, it can be difficult for a user to lift or control the movement of the container, especially when the container is filled. To this end, it can be difficult for a user to obtain a reliable grip on the round portion of a container for holding bleach in the example above. Moreover, containers such as rectilinear boxes fill space efficiently when a plurality of the containers are put in abutting relation on a shelf or other storage device, but this close abutting relation can make it highly difficult for a user to obtain a good initial grip on one of the containers to remove it from the shelf or storage device. In addition, product labels on the container may be damaged by rubbing against adjacent containers when stored on a shelf or other surface.

As a result, container manufacturers have conventionally added features to the known container designs to help make lifting and controlling movement of the container easier. In one well-understood example, one or more handles are affixed to the exterior surface of the container in order to permit grasping of the container. However, the inclusion of such handles adds complexity and cost to the manufacturing process, and these handles may also negatively affect the overall appearance of the container or make it difficult to apply product labels to the container. Separately added handles may also have a tendency to break off in certain extreme operating conditions, which can be potentially harmful to users of the containers.

In the laboratory and scientific fields, product containers may be used to hold liquid or dry chemicals, including some hazardous materials. The product label on such containers contains vital information that distinguishes the contents of that container from other containers while also giving warnings about any hazards associated with the chemicals stored therein. The typical round bottle used in these circumstances suffers from the problems above and also makes it difficult to orient the product labels so that each container and the chemicals therein can be identified before moving the containers off of a shelf. Furthermore, users are typically holding and moving these chemical containers with gloved hands, and it can be exceedingly difficult to obtain a reliable grip on the container (especially round containers) when wearing gloves.

Accordingly, there remains a need in the art for a container that overcomes the disadvantages with conventional containers identified above.

SUMMARY OF THE INVENTION

The present invention overcomes the foregoing and other shortcomings and drawbacks of containers heretofore known. While the invention will be described in connection with an exemplary embodiment, it will be understood that the invention is not limited to this embodiment. On the contrary, the invention includes all alternatives, modifications and equivalents as may be included within the spirit and scope of the present invention.

In one embodiment, a product container includes a top portion defining an opening, a bottom portion defining a base, and a central portion. At least a part of the top portion defines a first maximum cross sectional area extending in a horizontal plane, and at least a part of the bottom portion defines a second maximum cross sectional area extending in a horizontal plane. The central portion includes a plurality of sidewalls that extend between the top and bottom portions. A narrowed waist portion is defined by at least three adjacent sidewalls in the plurality of sidewalls, the narrowed waist portion defining a waist cross sectional area extending in a horizontal plane. This waist cross sectional area is smaller than each of the first and second maximum cross sectional areas, thereby enhancing the ability for a user to grip the product container at the narrowed waist portion while also providing clearance between containers when multiple containers are placed in abutting relation on a support surface. Each of the adjacent sidewalls that define the narrowed waist portion may consist of a plurality of discrete planar facets, thereby forming the narrowed waist portion with discrete planar facets. The planar facets enable labeling of the product container adjacent a gripping location, at least in this embodiment.

To this end, the narrowed waist portion in one aspect is formed by adjacent discrete planar facets which each define a smooth flat outer surface without projections or depressions. The smooth flat outer surface is configured to receive a flat product label during labeling of the product container. Advantageously, the user's attention is drawn to the location with the label when the user looks to grip and move the container at the narrowed waist portion. In another aspect, the bottom portion includes a bottom surface depression extending upwardly from the base to define a shoulder. The bottom surface depression is configured to receive one or more of a user's fingers to stabilize the product container when lifted for movement at the narrowed waist portion. More specifically, a user's finger(s) will slide into abutment with the shoulder and then hold the product container generally stationary, which lowers any risk of the product container sliding or pivoting out of the hand gripping the narrowed waist portion, especially in laboratory and scientific environments where users are wearing gloves while handling the container.

In yet another aspect, the first and second maximum cross sectional areas are equal to one another. Such an arrangement provides a symmetrical appearance for the product container similar in some respects to an hourglass having a narrowed center and larger ends. Furthermore, the central portion may include four sidewalls such that the product container defines a generally square shaped cross section extending in a horizontal plane at junctions between the plurality of sidewalls and the top and bottom portions. The central portion may also include a different number of sidewalls to provide a different external contour and appearance in other embodiments. The top portion may also include a neck defining the opening and including threads configured to engage a cap that is used to selectively close the opening in the top portion.

In another embodiment according to the invention, a product container once again includes a top portion defining an opening, a bottom portion defining a base, and a central portion, which includes a plurality of sidewalls extending between the top and bottom portions and has a narrowed waist portion with a smaller cross sectional area. In this regard, three adjacent sidewalls in the central portion include abutting discrete planar facets that collectively define the narrowed waist portion. At least one of the other sidewalls extending between the top and bottom portions remains spaced from the discrete planar facets collectively defining the narrowed waist portion in this embodiment. For example, the product container may include four sidewalls, with one of the sidewalls extending in a generally vertical and planar manner between the top and bottom portions to define a back wall opposite the narrowed waist portion.

In another type of embodiment according to the invention, a product container includes a top portion defining an opening, a bottom portion defining a base, and a central portion with a plurality of sidewalls that extend between the top and bottom portions such that at least some of the sidewalls collectively define a narrowed waist portion. Two of the sidewalls defining the narrowed waist portion include only three discrete planar facets that are disposed at an angle relative to and converge toward a fourth discrete planar facet that is oriented in a generally vertical direction. To this end, the product container may include four sidewalls, and the two walls with three converging planar facets may be located on opposite sides to delimit and space the narrowed waist portion from a rearmost of the sidewalls. Once again, a user is guided to grip the product container at the narrowed waist portion for reliable movement and control of the container.

In other alternative embodiments according to the invention, the top portion may define a first maximum width dimension and a first maximum depth dimension, while the bottom portion defines a second maximum width dimension and a second maximum depth dimension. The narrowed waist portion formed by the sidewalls of the central portion may then define a waist width dimension that is smaller than each of the first and second maximum width dimensions, and/or a waist depth dimension that is smaller than each of the first and second maximum depth dimensions. To this end, the narrowed waist portion may only limit the size of the product container in one general direction to enhance gripping rather than the entire cross sectional area of the container taken along a horizontal plane. However, it will be understood that these alternative embodiments may be used in combination with any or all of the features described above as well.

These and various additional aspects and features of the present invention will become more readily apparent to those of ordinary skill upon review of the following detailed description taken in conjunction with the drawings of the exemplary embodiment.

BRIEF DESCRIPTION OF THE DRAWINGS

The accompanying drawings, which are incorporated in and constitute a part of this specification, illustrate an embodiment of the invention and, together with a general description of the invention given above, and the detailed description given below, serve to explain the principles of the invention.

Figure 1:
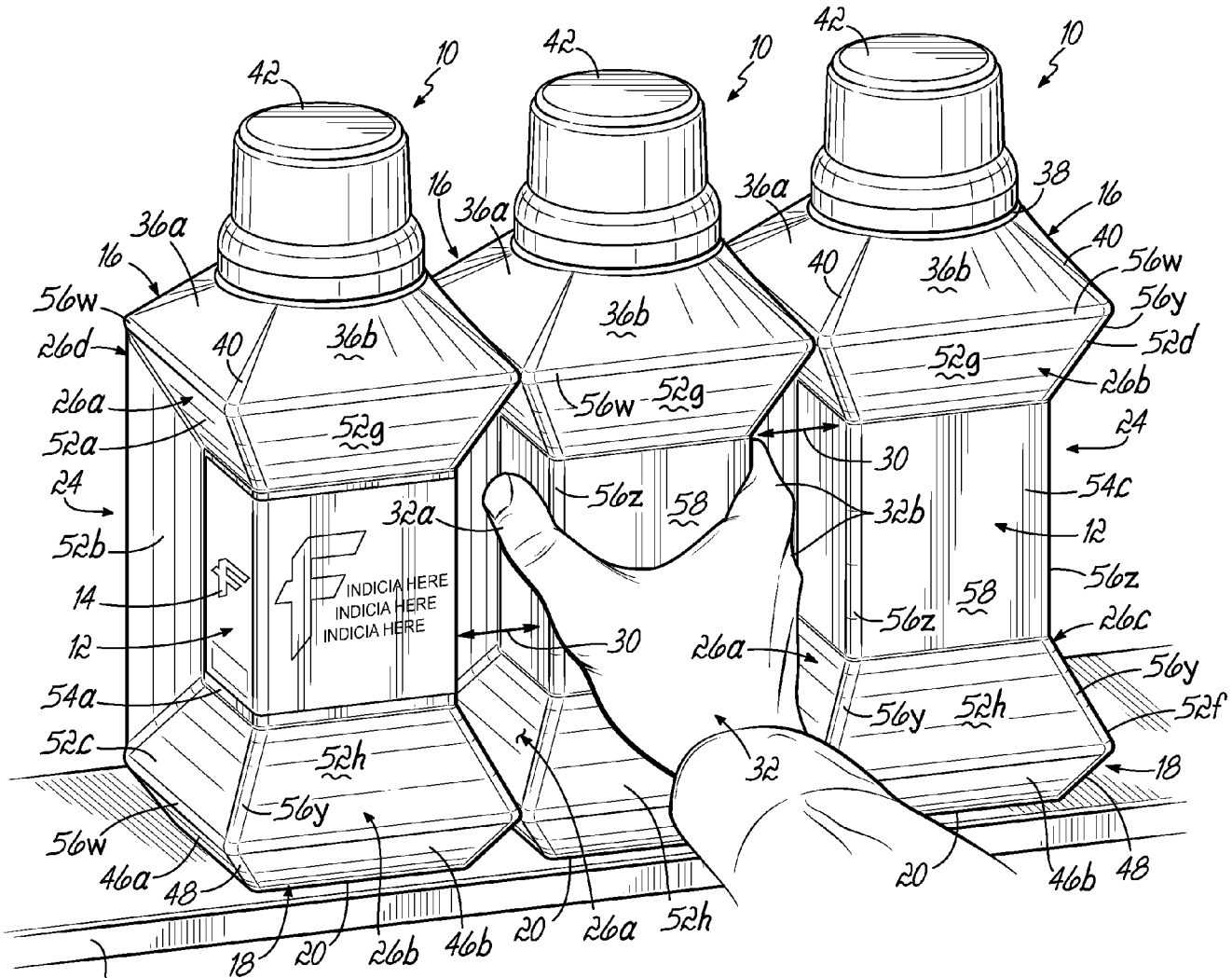
FIG. 1 is a front left perspective view of a plurality of product containers in accordance with one embodiment of the present invention, the product containers abutting each other on a shelf to illustrate a clearance for gripping the product container which is provided by a narrowed waist portion on the abutting product containers.

It should be understood that the appended drawings are not necessarily to scale, presenting a somewhat simplified representation of various preferred features illustrative of the basic principles of the invention. The specific design features of the containers as disclosed herein, including, for example, specific dimensions, orientations, locations, and shapes of various illustrated components, will be determined in part by the particular intended application and use environment. Certain features of the illustrated embodiments may have been enlarged or distorted relative to others to facilitate visualization and clear understanding.

DETAILED DESCRIPTION

With reference to FIGS. 1 through 5, an exemplary embodiment of a product container 10 configured to hold chemicals, liquids and/or solid particulate is shown in accordance with the present invention. More specifically, the product container 10 includes contours and/or features such as a narrowed waist portion 12, which help a user grasp the container 10 and control the container 10 during movement between storage and worksites. Unlike conventional containers with separately added handles, the narrowed waist portion 12 is incorporated into the design of the container 10 itself while also advantageously providing a surface for receiving a flat product label 14 as shown in the leftmost of the three product containers 10 in FIG. 1. Consequently, the product container 10 defines a distinctive contoured appearance while also enhancing a user's ability to grasp and control movements of the container 10, even when wearing protective gloves in a laboratory or scientific environment, while not adversely affecting the needs for detailed product labeling in certain industries.

The contoured shape of the container 10 also protects the product label 14 from damage, as will be described in further detail below. The product label 14 will naturally be facing outwardly when the user replaces the container 10 on a shelf because the product label 14 is located on the side of the container 10 where gripping occurs, so the container 10 also helps ensure that the product labels 14 will be readable when the container 10 is placed with other containers 10 on a storage shelf. The container 10 will be understood to be formed from various different types of materials depending on the needs of the end user, but plastic and glass are typical exemplary materials for the product containers 10 of the present invention.

With continued reference to FIG. 1, each of the product containers 10 includes a top portion 16 defining an opening (not shown in FIG. 1) and a bottom portion 18 opposite the top portion 16 and defining a base 20. As well understood in this field, the product containers 10 are configured to sit on the base 20 when placed upon a support surface, such as the shelf 22 shown in this Figure, and the opening provides selective access into the interior of the product container 10 so that the liquid or solid particulate material therein can be accessed. The product container 10 also includes a central portion 24 extending between the top and bottom portions 16, 18, with the narrowed waist portion 12 located at this central portion 24. More specifically, the central portion 24 extends generally from a maximum cross section of the container 10 located at the bottom of the top portion 16 to another maximum cross section of the container 10 located at the top of the bottom portion 18, and the narrowed waist portion 12 represents a partial portion or subset of the central portion 24.

The exemplary embodiment of the product container 10 is generally square-shaped along horizontal planes taken through the container 10, especially at junctions between the central portion 24 and the top and bottom portions 16, 18. As a result, the central portion 24 includes a plurality of sidewalls 26*a*, 26*b*, 26*c*, 26*d* (also collectively referred to as "26" below even though that reference numeral does not appear separately in the FIGS.) that are configured to abut one another when multiple product containers 10 are placed side-by-side on the shelf 22 as shown in FIG. 1. Each of the sidewalls 26*a*, 26*b*, 26*c*, 26*d* extends vertically along an entire distance from the bottom of the top portion 16 to the top of the bottom portion 18.

Consequently, the narrowed waist portions 12 of two adjacent product containers 10 advantageously provides a lateral clearance 30 or open space between the adjacent sidewalls 26*a*, 26*c* abutting one another in this configuration. The lateral clearance 30 is partially defined by the narrowed waist portion 12 of one product container 10 and partially defined by the narrowed waist portion 12 of the adjacent product container 10. As shown most clearly in FIG. 1, the lateral clearance 30 is sized to provide enough room for a user's hand 32 to be inserted between the adjacent product containers 10 in order to obtain a grip on the narrowed waist portion 12 of the product container 10 shown in the center of the shelf 22 in FIG. 1. More particularly, the gap defined by the lateral clearances 30 is large enough to receive the thumb 32*a* of the user's hand 32 on one side and the fingers 32*b* of the user's hand 32 on the other side, even when those fingers 32*b* and thumb 32*a* are within protective gloves as typically used in the laboratory and scientific environment. It will be understood that the particular size and shape of the lateral clearance 30 may be modified in other embodiments of the container 10. Thus, even when a multitude of product containers 10 is stored in abutting side-by-side relationship on the shelf 22, a user can grasp and remove any of the product containers 10 with relative ease. Furthermore, the product labels 14 on each of the product containers 10 (only shown on one container in FIG. 1) remain readily visible at the point of grasping these product containers 10 and are protected from being damaged by adjacent product containers 10. Furthermore, when the product containers 10 are placed back on the shelf 22, the product labels 14 will naturally be facing outwardly where they can be viewed by later users needing access to the contents of the containers 10.

Figure 2:
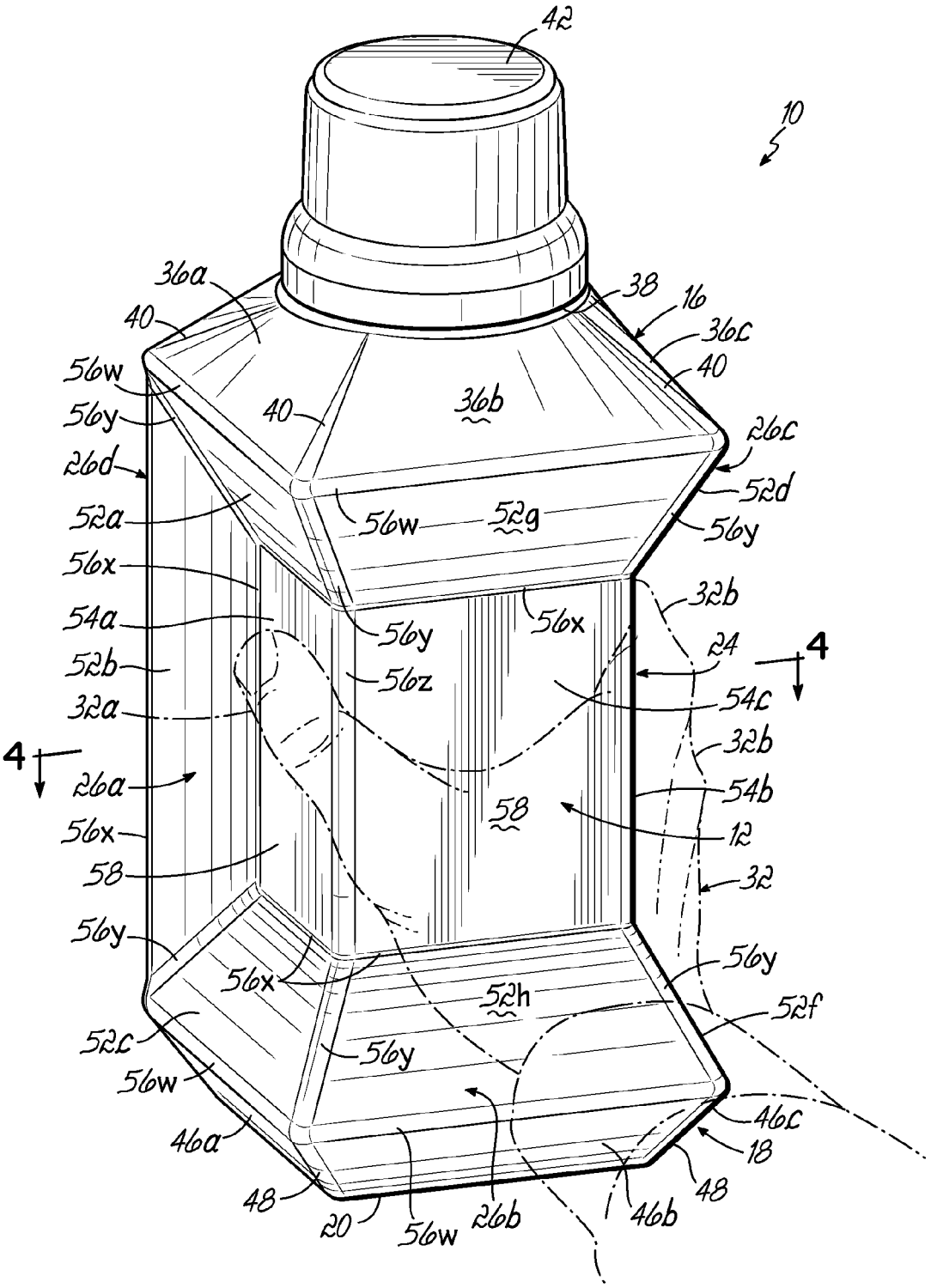
FIG. 2 is a view similar to FIG. 1 and showing a single one of the product containers, with a user's hand shown in phantom to illustrate gripping of the product container at the narrowed waist portion.
Figure 3:
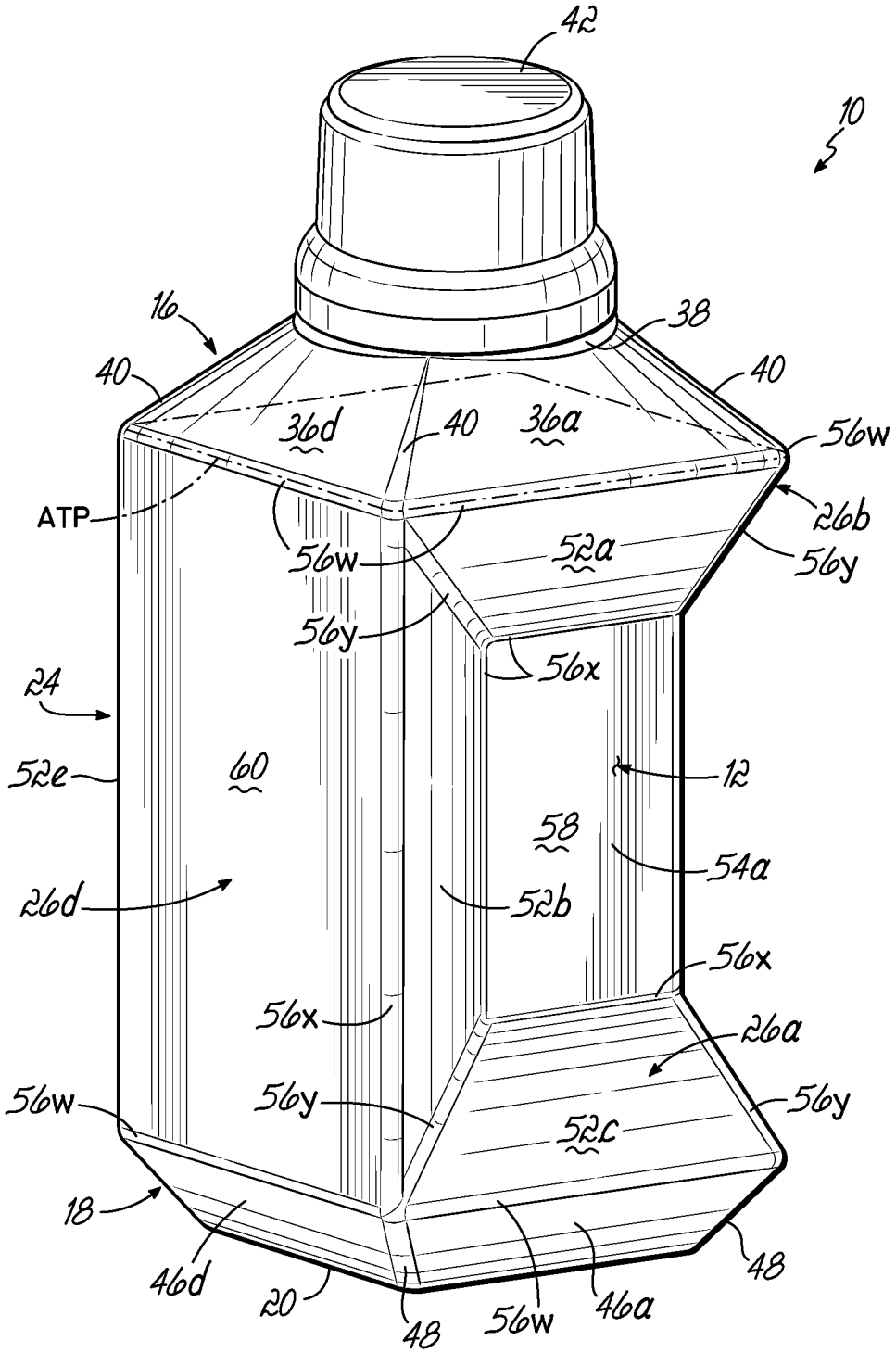
FIG. 3 is a rear left perspective view of the product container of FIG. 2.

Additional features of the product container are shown with reference to FIGS. 2 and 3, which show different angled perspective views taken from outside a single one of the product containers 10 according to this embodiment. To this end, the top portion 16 is further defined by a plurality of contoured facets 36*a*, 36*b*, 36*c*, 36*d* (also collectively referred to as "36" below even though that reference numeral does not appear separately in the FIGS.) extending between a neck portion 38 at the top of the product container 10 and the plurality of sidewalls 26 in the central portion 24. In the square-shaped embodiment of the product container 10 according to this embodiment, there are four contoured facets 36*a*, 36*b*, 36*c*, 36*d* included in the top portion 16, with each of the contoured facets 36*a*, 36*b*, 36*c*, 36*d* extending to a junction with a corresponding one of the sidewalls 26*a*, 26*b*, 26*c*, 26*d*. However, it will be understood that more or fewer contoured facets 36 may be provided in other similar embodiments of the product container 10, especially when the number of sidewalls 26 is modified from the exemplary embodiment.

Each of the contoured facets 36 define a more planar contour adjacent the plurality of sidewalls 26 and a more rounded contour adjacent the neck portion 38 as a result of the round profile of the neck portion 38 and the square-shaped profile of the central portion 24. Even with the transition to the more rounded contour, the contoured facets 36 provide a generally four-sided or square-shaped cross-sectional appearance in a horizontal plane along most of the longitudinal length (measured top to bottom) of the contoured facets 36. The contoured facets 36 each become generally wider going from the neck portion 38 to the central portion 24, which causes the top portion 16 to expand in size to a maximum size at a junction with the sidewalls 26 of the central portion 24. This maximum size defines a first maximum cross sectional area for the product container 10 as described in further detail below. As noted above, the central portion 24 extends downwardly from the location where the contoured facets 36 define the first maximum cross sectional area. Moreover, each of the contoured facets 36*a*, 36*b*, 36*c*, 36*d* has a generally trapezoidal appearance when viewed straight on, but the trapezoidal shape is rounded along the top at the neck portion 38 as described above.

Adjacent pairs of the contoured facets 36 abut one another at discrete corners 40 that are more sharp or angled towards the junction with the central portion 24 and the sidewalls 26. Each of the corners 40 becomes less sharp and begins to smooth out entirely towards the neck portion 38 as a result of the rounding along the top end of the contoured facets 36. It will be appreciated that the specific shapes and contours of the contoured facets 36 and the corners 40 may be modified in other embodiments, such as, for example, including less rounding when a round neck portion 38 is not present in the product container 10.

The neck portion 38 is largely concealed in the views of FIGS. 2 and 3 as a result of engagement with a cap 42 that is configured to close the opening (not shown in these FIGS.) at the top portion 16. The specific engagement of the cap 42 with the neck portion 38 is described in further detail below with reference to FIG. 5, but the cap 42 of this embodiment is located proximate to the contoured facets 36 when fully engaged with the neck portion 38 as shown. Therefore, the cap 42 and contoured facets 36 provide the desirable outward appearance of essentially the entire top portion 16 when the product container 10 is fully assembled with the cap 42. The specific features of the cap 42 may be modified in other embodiments without departing from the advantageous design of the product container 10.

Similar to the top portion 16, the bottom portion 18 is also at least partially defined by a plurality of facets extending between the base 20 and the central portion 24. In this regard, the bottom portion 18 of the illustrated embodiment includes four planar facets 46*a*, 46*b*, 46*c*, 46*d* (also collectively referred to as "46" below even though that reference numeral does not appear separately in the FIGS.), each extending upwardly and outwardly from the base 20 to a junction with a corresponding one of the sidewalls 26*a*, 26*b*, 26*c*, 26*d*. Whenever the term "planar facet" or "discrete planar facet" is used throughout this specification, it will be understood that the panel or surface defined by this facet may be generally or substantially planar and therefore may include some minor variations in contour, including, but not limited to grip-enhancing projections and depressions, without departing from the scope of this term. Each of the planar facets 46*a*, 46*b*, 46*c*, 46*d* in the bottom portion 18 defines a generally trapezoidal shape with angled edges that define corners 48 with adjacent planar facets 46. The planar facets 46 increase in width towards the central portion 24, which causes the bottom portion 18 to expand in size from the base 20 to a maximum size at the junction with the sidewalls 26. This maximum size defines a second maximum cross sectional area for the product container 10 as described in further detail below. As noted above, the central portion 24 extends upwardly from the location where the planar facets 46 define the second maximum cross sectional area. It will also be understood that the four planar facets 46*a*, 46*b*, 46*c*, 46*d* may be used as temporary support surfaces or bases for the product container 10 in a tilted orientation when pipetting liquid from a nearly empty product container 10, in some embodiments.

As a result of including four planar facets 46, the product container 10 defines a generally square-shaped appearance or horizontal cross section along this bottom portion 18. Of course, the number of planar facets 46 and specific configuration may be modified in other embodiments depending on the preferences and needs of the end user of the product container 10, which would result in a corresponding change in appearance and horizontal cross section. In the exemplary embodiment shown, the base 20 defines a generally square-shaped surface upon which the product container 10 sits when placed on a shelf 22 or other support surface. The base 20 is oriented so as to be generally planar and horizontal to reliably support the product container 10 in the upright position shown in these FIGS. The base 20 may also be located adjacent a bottom surface depression (not shown in FIGS. 2 and 3) described in further detail below.

With continued reference to FIGS. 2 and 3, the external profile defined along the central portion 24 of the product container 10 is shown in further detail. In the exemplary embodiment, the central portion 24 includes left and right sidewalls 26*a*, 26*c* which each extend between a front sidewall 26*b* and a rear sidewall 26*d*. Each of these sidewalls 26*a*, 26*b*, 26*c*, and 26*d* is defined by one or more facets and corners to provide the specific container profile, which in the exemplary embodiment includes the narrowed waist portion 12. As shown in this embodiment, the narrowed waist portion 12 is defined along only a partial portion or subset of the central portion 24. More specifically, in the embodiment shown in FIGS. 2 and 3, each of the sidewalls 26*a*, 26*b*, 26*c*, and 26*d* consists solely of one or more discrete planar facets. The specific arrangement of facets for the central portion 24 in this embodiment is described in detail below, but it will be appreciated that the arrangement and sizing of the facets may be modified in other embodiments. Furthermore, still other embodiments of the product container 10 may include additional structures and facets in addition to, or in lieu of, the discrete planar facets.

Beginning with the left sidewall 26*a*, a portion of the narrowed waist portion 12 of the product container 10 is defined along this left sidewall 26*a*. For example, the left sidewall 26*a* includes three discrete converging planar facets 52*a*, 52*b*, 52*c* (these and other converging planar facets on the sidewalls 26 are also collectively referred to as "52" below even though that reference numeral does not appear separately in the FIGS.) that are angled from and converge inwardly to a fourth discrete vertical planar facet 54*a* (these and other vertical planar facets on the sidewalls 26 are also collectively referred to as "54" below even though that reference numeral does not appear separately in the FIGS.). More specifically, one of the discrete converging planar facets 52*a* converges inwardly from a corner 56*w* formed with one of the contoured facets 36*a* of the top portion 16 of the container 10, another of the discrete converging planar facets 52*b* converges inwardly from another corner 56*x* formed with the rear sidewall 26*d*, and another of the discrete converging planar facets 52*c* converges inwardly from yet another corner 56*w*, this one formed with one of the planar facets 46*a* of the bottom portion 18 of the container 10. In this regard, and as described in further detail below, these converging planar facets 52 therefore reduce the size and cross-sectional area defined by the product container 10 from a maximum value down to smaller values at the narrowed waist portion 12. It will be understood that while the reference numeral 56*w* is used to refer to a type of corner formed between a converging planar facet 52 and the top or bottom portions 16, 18 of the container 10 and while the reference number 56*x* is used to refer to a type of corner formed between a converging planar facet 52 and a generally vertical facet, these and other corners are also collectively referred to as "56" below even though that reference numeral does not appear separately in the FIGS.

As shown most clearly in FIG. 2, the converging and angling inwardly of the converging planar facets 52 is enabled by each of these converging planar facets 52 defining a generally trapezoidal shape when viewed straight on. At each edge of the trapezoidal shape of the converging planar facets 52, a corner 56 is formed with another facet, whether that other facet is located on another of the sidewalls 26 or on the top and bottom portions 16, 18. For example, in addition to the corners 56*w* and 56*x* described above, the converging planar facets 52*a*, 52*b*, 52*c* of the left sidewall 26*a* share corners 56*y* between each other and with other converging planar facets 52 on the front sidewall 26*b* (described in further detail below), and an internal type of corner 56*x* with the fourth discrete vertical planar facet 54*a*. It will be understood that while the reference numeral 56*y* is used to refer to a type of corner formed between two converging planar facets 52, these and other corners are also collectively referred to as "56" below even though that reference numeral does not appear separately in the FIGS.

As a result of the converging inwardly of these facets 52, the vertical planar facet 54*a* that forms a portion of the narrowed waist portion 12 is spaced apart from the top and bottom portions 16, 18 and also spaced apart from the rear sidewall 26*d* in the central portion 24 (this is also why the narrowed waist portion 12 defines only a subset of the central portion 24 of the product container 10). The specific angling formed at the corners 56*x* between the converging planar facets 52*a*, 52*b*, 52*c* and the vertical planar facet 54*a* may be modified in other embodiments to change the size and shape of the narrowed waist portion 12 relative to the remainder of the product container 10 without departing from the scope of the present invention. Furthermore, other non-illustrated embodiments may include a different number of planar facets or a combination of additional facets and surfaces depending on the end shape of the product container to be formed, so long as the left sidewall 26*a* continues to span the distance between the top and bottom portions 16, 18 while also defining the narrowed waist portion 12.

However, the exemplary embodiment of the product container 10 shown in the FIGS. is advantageous at least because the use of only four discrete planar facets (e.g., 52*a*, 52*b*, 52*c*, 54*a*) in a sidewall 26*a* forming a part of the narrowed waist portion 12 enables simplified manufacturing and a desirable profile for grasping the product container 10 as well as for labeling the container 10. Therefore, the specific combination of solely discrete planar facets 52*a*, 52*b*, 52*c*, 54*a* shown in the exemplary embodiment provides important benefits, even if this or other sidewalls 26 of the product container 10 are modified as alluded to above. Although not shown in a profile view in FIGS. 2 and 3, it will be understood that the right sidewall 26*c* is identical (but a mirror image) to the left sidewall 26*a*. Consequently, the right sidewall 26*c* also includes three converging planar facets 52*d*, 52*e*, 52*f* that are angled from and converge towards a vertical planar facet 54*b* defining a portion of the narrowed waist portion 12.

Like the left sidewall 26*a*, the first converging planar facet 52*d* extends between corners 56*y* formed with adjacent converging planar facets 52 and also extends between a corner 56*w* formed with one of the contoured facets 36*c* of the top portion 16 and a corner 56*x* formed with the vertical planar facet 54*b*; the second converging planar facet 52*e* extends between corners 56*y* formed with adjacent converging planar facets 52*d*, 52*f* and also extends between a corner 56*x* formed with the rear sidewall 26*d* and a corner 56*x* formed with the vertical planar facet 54*b*; and the third converging planar facet 52*f* extends between corners 56*y* formed with adjacent converging planar facets 52 and also extends between a corner 56*w* formed with one of the planar facets 46*c* of the bottom portion 18 and a corner 56*x* formed with the vertical planar facet 54*b*. It will be understood that some of these facets 52, 54 and corners 56 are not shown except at edge profiles in FIGS. 1 through 3. However, further detailed description of these identical opposing sidewalls 26*a*, 26*c* is unnecessary in view of the description provided above.

Turning to the front sidewall 26*b*, a similar arrangement of planar facets is provided (see FIG. 2). However, because the front sidewall 26*b* is adjacent to and abutting two other sidewalls 26*a*, 26*c* that form a portion of the narrowed waist portion 12, the front sidewall 26*b* only includes two converging planar facets 52*g*, 52*h* angled from and converging inwardly to a third vertical planar facet 54*c*. Each of the converging planar facets 52*g*, 52*h* defines a generally trapezoidal shape when viewed straight on in order to produce this inward taper or narrowing of the product container 10 at the narrowed waist portion 12. One of the converging planar facets 52*g* extends between corners 56*y* formed with adjacent converging planar facets 52*a*, 52*d* on other sidewalls 26*a*, 26*c* and also extends between a corner 56*w* formed with one of the contoured facets 36*b* of the top portion 16 and a corner 56*x* formed with the vertical planar facet 54*c*. Another of the converging planar facets 52*h* extends between corners 56*y* formed with adjacent converging planar facets 52*c*, 52*f* formed on other sidewalls 26*a*, 26*c* and also extends between a corner 56*w* formed with one of the planar facets 46*b* of the bottom portion 18 and a corner 56*x* formed with the vertical planar facet 54*c*.

Therefore, the three adjacent and abutting vertical planar facets 54*a*, 54*b*, 54*c* defining the narrowed waist portion 12 are effectively surrounded circumferentially on all sides by these converging planar facets 52*a*, 52*b*, 52*c*, 52*d*, 52*e*, 52*f*, 52*g*, 52*h* formed in the corresponding three adjacent sidewalls 26*a*, 26*b*, and 26*c*. This arrangement causes the vertical planar facets 54 defining the narrowed waist portion 12 to be spaced from each of the top and bottom portions 16, 18 as well as the rear sidewall 26*d*. The abutting vertical planar facets 54*a*, 54*b*, 54*c* are connected to one another along corners 56*z*, and this reference numeral is used to refer to corners 56 located between two generally vertical facets 54. Although there are a total of eight converging planar facets 52 shown in the exemplary embodiment, it will be understood that more or fewer of these facets may be provided when the container 10 includes more sidewalls 26, and each of the sidewalls 26 defining ends of the narrowed waist portion 12 will generally include three converging planar facets 52 while sidewalls 26 in between these ends of the narrowed waist portion 12 will include only two converging planar facets 52.

As briefly described above, the three adjacent vertical planar facets 54*a*, 54*b*, 54*c* along the sidewalls 26*a*, 26*b*, and 26*c* provide both clearance to grasp the product container 10 along the narrowed waist portion 12 as well as a convenient forward-facing surface to label the container 10 with a flat product label 14. To this end, in the exemplary embodiment each of the vertical planar facets 54*a*, 54*b*, 54*c* further defines a smooth flat outer surface 58 facing away from the remainder of the product container 10. The smooth flat outer surface 58 is specifically provided with no projections or depressions that would adversely affect the application and adhesion of the flat product label 14 to the product container 10 at the narrowed waist portion 12. The application of the product label 14 at these smooth flat outer surfaces 58 encourages the user's attention to be drawn to the same location both when picking up the product container 10 to move it and while identifying the contents and any ancillary instructions provided for the container 10 and its contents. Thus, in addition to simplified manufacturing and a desirable aesthetic appearance, the narrowed waist portion 12 also provides practical benefits for the ease of the end user.

The rear sidewall 26*d* is shown most clearly with reference to FIG. 3. In the exemplary embodiment, this rear sidewall 26*d* includes a single discrete planar facet 60 that extends the entire distance between a corner 56*w* at the top portion 16 and a corner 56*w* at the bottom portion 18. The single discrete planar facet 60 also extends between corners 56*x* formed with the rearmost converging planar facets 52*b*, 52*e* of the other sidewalls 26*a*, 26*c*. Although the planar facet 60 of the rear sidewall 26*d* extends along a generally vertical direction in this embodiment, it will be understood that this planar facet 60 may be oriented non-vertically in other embodiments (such as when the top and bottom portions 16, 18 do not define the same maximum dimensions and cross sectional area. Furthermore, the rear sidewall 26*d* may be defined by more than one facet having different profiles and shapes in other embodiments. Regardless of the particular configuration chosen for the rear sidewall 26*d*, the rear sidewall 26*d* remains spaced from the vertical planar facets 54*a*, 54*b*, 54*c* that define the narrowed waist portion 12 as the rear sidewall 26*d* extends between the top and bottom portions 16, 18 of the product container 10. The generally planar rear sidewall 26*d* of the exemplary embodiment enables multiple rows of product containers 10 to be placed side-by-side and in close abutment front-to-back along a shelf 22 while maximizing the internal volume of the product container 10 in regions away from the narrowed waist portion 12.

Figure 4:
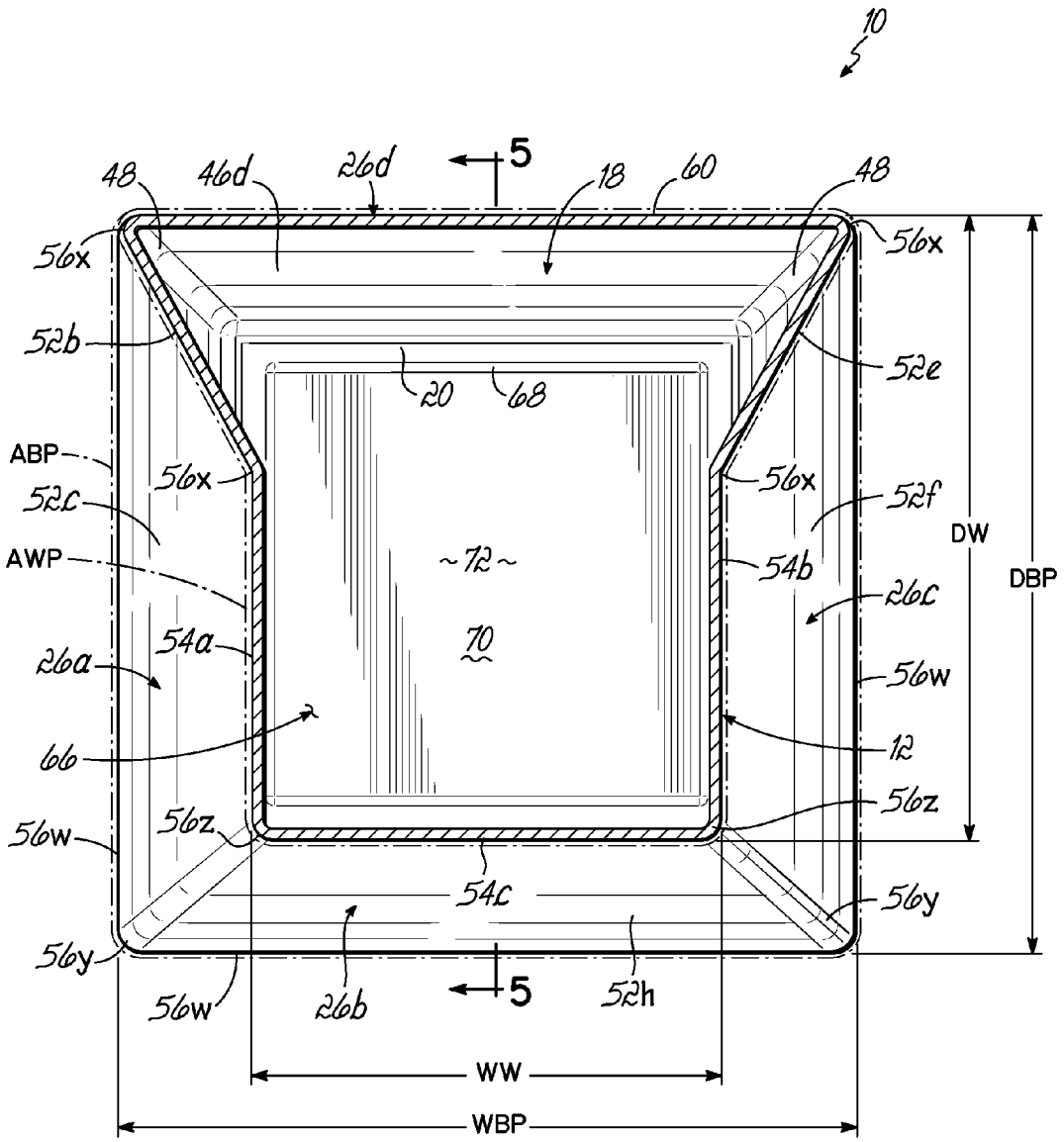
FIG. 4 is a partial cross-sectional view of the product container of FIG. 2, taken along a generally horizontal plane shown by line 4-4 in FIG. 2, so as to illustrate further contours of the narrowed waist portion.
Figure 5:
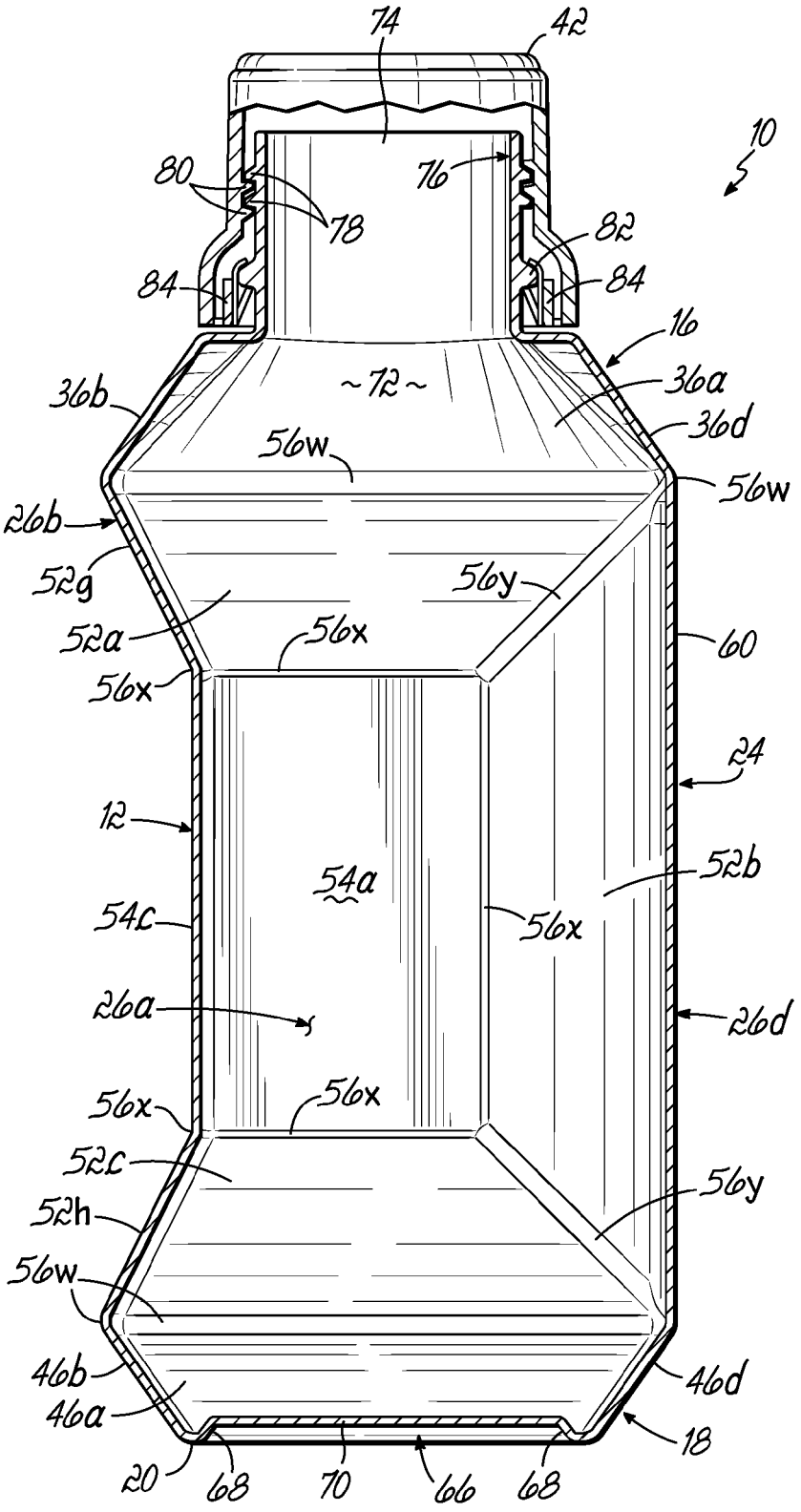
FIG. 5 is a partial cross-sectional view of the product container of FIG. 4, taken along a generally vertical plane shown by line 5-5 in FIG. 4, so as to illustrate additional contours and features at top and bottom portions of the product container.

With reference to FIGS. 4 and 5, additional features of the product container 10 of the exemplary embodiment are revealed using cross sections through the container 10. These cross sections reveal the beneficial reduction of dimensions and/or cross sectional area at the narrowed waist portion 12 relative to the top and bottom portions 16, 18, which assists with helping the user obtain a handle-like grip on the product container 10, even when the user is wearing gloves in a laboratory or scientific environment.

As shown most specifically in FIG. 4, the bottom portion 18 defines a second maximum cross sectional area ABP that is simulated in phantom lines surrounding the periphery of the product container 10 in that top-down view. As readily understood from the previous discussion of the perspective views, the bottom portion 18 defines this square-shaped second maximum cross sectional area ABP at the junction with the central portion 24, e.g., along the corners 56*w* formed at the bottom edges of the sidewalls 26. The narrowed waist portion 12 of the exemplary embodiment reduces the cross sectional area to the (smaller) waist cross sectional area AWP, which is also shown schematically in a phantom line surrounding the periphery of the cross-sectioned portion shown in FIG. 4. This waist cross sectional area AWP is also smaller than the first maximum cross sectional area ATP defined at the top portion 16. In the exemplary embodiment shown in these FIGS., the first and second maximum cross sectional areas ATP, ABP are identical in size because the top portion 16 and the bottom portion 18 of the product container 10 are formed to be roughly equivalent in size, but these cross sectional areas ATP, ABP may be differently sized in other embodiments so long as the waist cross sectional area AWP remains smaller than both.

It will also be understood that the narrowed waist portion 12 may instead be defined by one or more smaller dimensions rather than by a smaller cross sectional area in some embodiments. For example with reference to the exemplary embodiment shown in FIG. 4, the narrowed waist portion 12 defines a waist width dimension WW and a waist depth dimension DW for the product container 10 at the location of the vertical planar facets 54. One or both of these dimensions WW, DW is smaller in size than the corresponding maximum width dimension WBP and the corresponding maximum depth dimension DBP defined along the bottom portion 18 of the product container 10 (both dimensions are smaller in the exemplary embodiment). Although not shown in the downward cross section illustration of FIG. 4, the maximum width dimension and maximum depth dimension for the top portion 16 of the product container 10 would be identical to those shown for the bottom portion 18 in the exemplary embodiment, so these dimensions are not labeled and do not need to be shown to understand this reduction of dimensions at the narrowed waist portion 12. Regardless of whether the reduction in size of the narrowed waist portion 12 is along one dimension, two dimensions, or a cross sectional area, the reduction in size results in the advantageous benefits discussed in detail above (easier handling of the bottle, more clearance, desirable appearance, etc.).

With continued reference to FIGS. 4 and 5, the bottom portion 18 further includes a bottom surface depression 66 extending generally upwardly from the base 20. More particularly, the base 20 surrounds the bottom surface depression 66 in the exemplary embodiment circumferentially so that a shoulder 68 is formed between the base 20 and the bottom surface depression 66. The bottom surface depression 66 of the exemplary embodiment is defined by a square-shaped generally planar facet 70 connected to the base 20 at the four-sided shoulder 68, which matches the four-sided contour of the bottom portion 18 in this embodiment of the product container 10. However, it will be appreciated that non-planar and multiple facets could be used to define bottom surface depressions 66 having different contours in other embodiments.

The bottom surface depression 66 provides a space for receiving one or more of a user's fingers on the opposite hand from the one gripping the narrowed waist portion 12 as shown in FIGS. 1 and 2. These other fingers can abut against the shoulder 68 to stabilize the product container 10 from unnecessarily swinging around during movement, especially if the hand grip slips for some reason at the narrowed waist portion 12, and even if the user is wearing gloves while handling the product container 10. Therefore, it will be understood that the proposed modifications to the shape and size of the bottom surface depression 66 discussed above would not affect the functionality of providing the shoulder 68 to enhance the carrying capabilities for the user. In other embodiments where a bale handle or separate structure is used (not included in the exemplary embodiment), the bottom surface depression 66 serves as an even more reliable method of stabilizing the product container 10 during movement.

Even though the bottom surface depression 66 and the narrowed waist portion 12 define inward structures, the interior space 72 defined by the product container 10 remains maximized for holding liquids or solid particulate goods. To this end, the narrowed waist portion 12 and the bottom surface depression 66, at least in the exemplary embodiment shown in FIGS. 4 and 5, are limited in how far these elements extend inwardly towards the interior space 72. Furthermore, the exemplary embodiment of the product container 10 includes no other inwardly extending or blocking structures within the interior space 72 that would further reduce the storage capacity of the product container 10. Particularly when using the four-sided or square-shaped exemplary embodiment, the interior space 72 is generally maximized, and this increases efficiency of storage space use for the end user. Of course, similar benefits could also be achieved in other embodiments defining different shapes and sizes for the product container 10.

As briefly noted above, the interior space 72 is accessed in the exemplary embodiment via an opening 74, which is shown in FIG. 5 as being defined by a generally cylindrical extension 76 at the neck portion 38. The cylindrical extension 76 at the neck portion 38 includes external threads 78 which are configured to engage with internal threads 80 formed on the cap 42. Therefore, the cap 42 can be screwed into and out of engagement with the neck portion 38 along the corresponding threads 78, 80 to seal the opening 74 closed in the position shown in FIG. 5 or open access into the interior space 72 via the opening 74 when the cap 42 is removed. The generally cylindrical extension 76 may also include additional structures such as the radial flange 82 which engages with tamper-evident band features 84 provided on the cap 42 as well understood in the product container art. However, these structures and even the entire neck portion 38 itself may be omitted in other embodiments of the product container 10 consistent with the present invention, such as where the opening 74 is formed in one of the other facets 36 defining the top portion 16. To this end, the cap 42 and the neck portion 38 may be modified without affecting the advantageous benefits provided by the remainder of the design of the product container 10.

In view of the structural features described in detail above with reference to the exemplary embodiment in FIGS. 1 through 5, the product container 10 provides several advantages. For example, by forming the top and bottom portions 16, 18 and the central portion 24 with a plurality of discrete facets, the product container 10 can be formed by known molding processes such as blow molding and injection molding (regardless of the materials used), thereby simplifying manufacturing of the product container 10. No additional handle-like structures need to be separately added to the product container 10. Moreover, the narrowed waist portion 12 and bottom surface depression 66 provide natural places for gripping and stabilizing the product container 10 during movement (even when a user's hands are in gloves in a laboratory or scientific environment), while also enabling labeling of the product container 10 at the same location where attention is drawn for gripping and moving the product container 10. The product label 14 will naturally be positioned to face outwardly and will usually be readable when the product container 10 is put on a shelf as a result of the placement of the product label 14 at the narrowed waist portion 12 where gripping of the container 10 will occur. Accordingly, the product container 10 of the present invention addresses many of the drawbacks with conventional containers.

While the present invention has been illustrated by the description of an exemplary embodiment thereof, and while that embodiment has been described in considerable detail, it is not intended to restrict or in any way limit the scope of the appended claims to such detail. Additional advantages and modifications will readily appear to those skilled in the art. For example, the specific number and placement of discrete planar facets may be modified in other embodiments of the product container. The present invention in its broader aspects is therefore not limited to the specific details, representative apparatus and method and illustrative examples shown and described. Accordingly, departures may be from such details without departing from the scope or spirit of the general inventive concept.

What is claimed is:

1. A product container, comprising:

a top portion defining an opening, at least a part of the top portion defining a first maximum cross sectional area extending in a horizontal plane;

a bottom portion defining a base, at least a part of the bottom portion defining a second maximum cross sectional area extending in a horizontal plane; and a central portion including a plurality of sidewalls that extend between the top and bottom portions, at least three adjacent sidewalls in the plurality of sidewalls collectively defining a narrowed waist portion of the container, the narrowed waist portion being configured to be gripped by a user for lifting the container and defining a waist cross sectional area extending in a horizontal plane, the waist cross sectional area being smaller than each of the first and second maximum cross sectional areas, and wherein each of the at least three adjacent sidewalls defining the narrowed waist portion consists of a plurality of discrete planar facets, wherein the narrowed waist portion defines a minimum horizontal cross sectional area of the central portion of the product container, the minimum horizontal cross sectional area being defined at least partially by abutting, generally vertical discrete planar facets, at least one of which is included in each of the at least three adjacent sidewalls of the narrowed waist portion, and each of the abutting, generally vertical discrete planar facets defines a smooth flat outer surface without projections and/or depressions, the smooth flat outer surface being configured to receive a flat product label coupled to the product container.

2. The product container of claim 1, wherein the bottom portion includes a bottom surface depression extending upwardly from the base so as to define a shoulder between the bottom surface depression and the base, the bottom surface depression being configured to receive one or more of a user's fingers to stabilize the product container when lifted for movement at the narrowed waist portion.

3. The product container of claim 1, wherein the first maximum cross sectional area and the second maximum cross sectional area are equal.

4. The product container of claim 1, wherein the top portion includes a neck defining the opening and including threads configured to engage a cap that is used to close the opening in the top portion.

5. The product container of claim 1, wherein the plurality of sidewalls includes four sidewalls such that the product container defines a generally square-shaped cross section extending in a horizontal plane at junctions between the plurality of sidewalls and the top and bottom portions.

6. The product container of claim 1, wherein two of the adjacent sidewalls collectively defining the narrowed waist portion include only three discrete planar facets that are disposed at an angle relative to and converge toward a fourth discrete planar facet that is oriented in a generally vertical direction, with the narrowed waist portion being defined along the fourth discrete planar facet.

7. The product container of claim 6, wherein the adjacent sidewalls collectively defining the narrowed waist portion include abutting discrete planar facets that collectively define the narrowed waist portion, and wherein at least one other sidewall in the plurality of sidewalls extends between the top and bottom portions while remaining spaced from the discrete planar facets collectively defining the narrowed waist portion.

8. A product container, comprising:

a top portion defining an opening, at least a part of the top portion defining a first maximum cross sectional area extending in a horizontal plane;

a bottom portion defining a base, at least a part of the bottom portion defining a second maximum cross sectional area extending in a horizontal plane; and a central portion including a plurality of sidewalls that extend between the top and bottom portions, at least three adjacent sidewalls in the plurality of sidewalls including abutting discrete planar facets that collectively define a narrowed waist portion of the container, with each of the at least three adjacent sidewalls including only one of the discrete planar facets that define the narrowed waist portion, the narrowed waist portion configured to be gripped by a user lifting the container and defining a waist cross sectional area extending in a horizontal plane, the waist cross sectional area being smaller than each of the first and second maximum cross sectional areas, and wherein at least one other sidewall in the plurality of sidewalls is defined by only one discrete planar facet which extends between the top and bottom portions while remaining spaced from the discrete planar facets that collectively define the narrowed waist portion in the at least three adjacent sidewalls.

9. The product container of claim 8, wherein each of the abutting discrete planar facets defining the narrowed waist portion defines a smooth flat outer surface without projections and/or depressions, the smooth flat outer surface configured to receive a flat product label coupled to the product container.

10. The product container of claim 8, wherein the bottom portion includes a bottom surface depression extending upwardly from the base so as to define a shoulder between the bottom surface depression and the base, the bottom surface depression configured to receive one or more of a user's fingers to stabilize the product container when lifted for movement at the narrowed waist portion.

11. The product container of claim 8, wherein each of two of the adjacent sidewalls collectively defining the narrowed waist portion further includes only three discrete planar facets that are disposed at an angle relative to and converge toward a fourth discrete planar facet that is oriented in a generally vertical direction.

12. A product container, comprising:

a top portion defining an opening, at least a part of the top portion defining a first maximum cross sectional area extending in a horizontal plane;

a bottom portion defining a base, at least a part of the bottom portion defining a second maximum cross sectional area extending in a horizontal plane; and a central portion including a plurality of sidewalls that extend between the top and bottom portions, at least three adjacent sidewalls in the plurality of sidewalls collectively defining a narrowed waist portion of the container, the narrowed waist portion being configured to be gripped by a user for lifting the container and defining a waist cross sectional area extending in a horizontal plane, the waist cross sectional area being smaller than each of the first and second maximum cross sectional areas, and wherein two of the at least three adjacent sidewalls collectively defining the narrowed waist portion further include only three discrete planar facets that are disposed at an angle relative to and converge toward a fourth discrete planar facet that is oriented in a generally vertical direction.

13. The product container of claim 12, wherein the narrowed waist portion is formed by adjacent discrete planar facets, each of which defines a smooth flat outer surface without projections and/or depressions, the smooth flat outer surface being configured to receive a flat product label coupled to the product container.

14. The product container of claim 12, wherein the bottom portion includes a bottom surface depression extending upwardly from the base so as to define a shoulder between the bottom surface depression and the base, the bottom surface depression being configured to receive one or more of a user's fingers to stabilize the product container when lifted for movement at the narrowed waist portion.

15. A product container, comprising:

a top portion defining an opening, at least a part of the top portion defining a first maximum width dimension and a first maximum depth dimension;

a bottom portion defining a base, at least a part of the bottom portion defining a second maximum width dimension and a second maximum depth dimension which are spaced apart from the first maximum width dimension and the first maximum depth dimension along a longitudinal length of the container; and a central portion including a plurality of sidewalls that extend between the top and bottom portions, at least three adjacent sidewalls in the plurality of sidewalls collectively defining a narrowed waist portion of the container, the narrowed waist portion being configured to be gripped by a user for lifting the container and defining a waist width dimension and a waist depth dimension, with the waist width dimension being smaller than each of the first and second maximum width dimensions and/or the waist depth dimension being smaller than each of the first and second maximum depth dimensions, and wherein each of the at least three adjacent sidewalls defining the narrowed waist portion consists of a plurality of discrete planar facets wherein the narrowed waist portion defines a minimum horizontal cross sectional area of the central portion of the product container, the minimum horizontal cross sectional area being defined at least partially by abutting, generally vertical discrete planar facets, at least one of which is included in each of the at least three adjacent sidewalls of the narrowed waist portion, and each of the abutting, generally vertical discrete planar facets defines a smooth flat outer surface without projections and/or depressions, the smooth flat outer surface being configured to receive a flat product label coupled to the product container.

16. The product container of claim 15, wherein each of two of the adjacent sidewalls collectively defining the narrowed waist portion includes only three discrete planar facets that are disposed at an angle relative to and converge toward a fourth discrete planar facet that is oriented in a generally vertical direction.

17. The product container of claim 16, wherein the adjacent sidewalls collectively defining the narrowed waist portion include abutting discrete planar facets that collectively define the narrowed waist portion, and wherein at least one other sidewall in the plurality of sidewalls extends between the top and bottom portions while remaining spaced from the discrete planar facets collectively defining the narrowed waist portion.

18. A product container, comprising:

a top portion defining an opening, at least a part of the top portion defining a first maximum width dimension and a first maximum depth dimension;

a bottom portion defining a base, at least a part of the bottom portion defining a second maximum width dimension and a second maximum depth dimension which are spaced apart from the first maximum width dimension and the first maximum depth dimension along a longitudinal length of the container; and a central portion including a plurality of sidewalls that extend between the top and bottom portions, at least three adjacent sidewalls in the plurality of sidewalls including abutting discrete planar facets that collectively define a narrowed waist portion of the container, with each of the at least three adjacent sidewalls including only one of the discrete planar facets that define the narrowed waist portion, the narrowed waist portion being configured to be gripped by a user for lifting the container and defining a waist width dimension and a waist depth dimension, with the waist width dimension being smaller than each of the first and second maximum width dimensions and/or the waist depth dimension being smaller than each of the first and second maximum depth dimensions, and wherein at least one other sidewall in the plurality of sidewalls is defined by only one discrete planar facet which extends between the top and bottom portions while remaining spaced from the discrete planar facets that collectively define the narrowed waist portion in the at least three adjacent sidewalls.

19. A product container, comprising:

a top portion defining an opening, at least a part of the top portion defining a first maximum width dimension and a first maximum depth dimension;

a bottom portion defining a base, at least a part of the bottom portion defining a second maximum width dimension and a second maximum depth dimension which are spaced apart from the first maximum width dimension and the first maximum depth dimension along a longitudinal length of the container; and a central portion including a plurality of sidewalls that extend between the top and bottom portions, at least three adjacent sidewalls in the plurality of sidewalls collectively defining a narrowed waist portion of the container, the narrowed waist portion being configured to be gripped by a user for lifting the container and defining a waist width dimension and a waist depth dimension, with the waist width dimension being smaller than each of the first and second maximum width dimensions and/or the waist depth dimension being smaller than each of the first and second maximum depth dimensions, and wherein two of the at least three adjacent sidewalls collectively defining the narrowed waist portion further include only three discrete planar facets that are disposed at an angle relative to and converge toward a fourth discrete planar facet that is oriented in a generally vertical direction.

* * * * *